US005240321A

United States Patent [19]

Miller

[11] Patent Number: 5,240,321

[45] Date of Patent: Aug. 31, 1993

[54] VERTICAL SCREW MIXER

[75] Inventor: Peter Miller, Wetaskiwin, Canada

[73] Assignee: Alteen Distributors Ltd., Canada

[21] Appl. No.: 756,485

[22] Filed: Sep. 9, 1991

[51] Int. Cl.[5] ..... B01F 7/16

[52] U.S. Cl. ..... 366/45; 366/154; 241/260.1; 241/261.1

[58] Field of Search ..... 241/246, 260.1, 261, 241/261.1; 366/45, 33, 35, 154, 156

[56] References Cited

U.S. PATENT DOCUMENTS

| | | | |
|---|---|---|---|
| 1,637,678 | 8/1927 | Camilla et al. . | |
| 1,727,672 | 9/1929 | Quick . | |
| 1,760,374 | 5/1930 | Pepper . | |
| 2,306,245 | 12/1942 | Duke . | |
| 2,382,040 | 8/1945 | Erickson . | |
| 2,800,238 | 7/1957 | Oliver . | |
| 2,894,733 | 7/1959 | Wosmek . | |
| 3,133,727 | 5/1964 | Luscombe . | |
| 3,156,451 | 11/1964 | Waas . | |
| 3,533,563 | 10/1970 | Eriksson | 241/261 X |
| 3,734,472 | 5/1973 | Strohmeier | 366/154 X |
| 4,092,014 | 5/1978 | Hughes . | |
| 4,168,805 | 9/1979 | Taylor | 241/260.1 X |
| 4,182,592 | 1/1980 | Henryson | 241/260.1 X |
| 4,188,132 | 2/1980 | Lenart et al. . | |
| 4,275,033 | 6/1981 | Schulte et al. | 366/156 X |
| 4,284,247 | 8/1981 | Eriksson | 241/260.1 X |
| 4,432,499 | 2/1984 | Henkensiefken et al. | 366/156 X |
| 4,765,747 | 8/1988 | High, Jr. et al. . | |
| 4,838,704 | 6/1989 | Carver . | |
| 4,852,817 | 8/1989 | Tipton | 241/260.1 |
| 4,896,970 | 1/1990 | Schuler | 241/260.1 |
| 4,984,900 | 1/1991 | Faccia . | |
| 4,993,502 | 1/1977 | Barcell . | |
| 5,020,918 | 7/1991 | Faccia . | |

FOREIGN PATENT DOCUMENTS

| | | | |
|---|---|---|---|
| 2024723 | 7/1973 | Fed. Rep. of Germany . | |
| 3535227 | 4/1986 | Fed. Rep. of Germany | 246/261 |
| 986490 | 1/1983 | U.S.S.R. | 241/246 |
| 1533862 | 1/1990 | U.S.S.R. . | |
| 2186810 | 8/1987 | United Kingdom . | |

OTHER PUBLICATIONS

Letter dated Jul. 22, 1991 responding to request regarding multiple screw mixer/feeder from Marmix Srl.

*Primary Examiner*—Mark Rosenbaum
*Assistant Examiner*—Frances Chin
*Attorney, Agent, or Firm*—Davis, Bujold & Streck

[57] ABSTRACT

A vertical screw mixer consisting of an elongate container having a bottom, first end, a second end, and containing walls which extend between the first end and the second end. At least one opening whereby raw materials are directed into the container. A plurality of generally conical processing screws are positioned at spaced intervals between the first end and the second end. Each of the processing screws has an axis of rotation which is angularly offset from vertical by inclining the axis of rotation toward the second end of the container, such that a flow of material is promoted from the first end toward the second end. A processed material outlet is positioned adjacent the second end whereby processed material exits the container.

8 Claims, 2 Drawing Sheets

VERTICAL SCREW MIXER

The present invention relates to a vertical screw mixer.

BACKGROUND OF THE INVENTION

Vertical screw mixers are commonly restricted to use in batch processing within parameters dictated by their volumetric capacity. A volume of material is placed within the mixer, and upon completion of processing is removed. It is not possible to use these mixers as components in a continuous flow process.

SUMMARY OF THE INVENTION

What is required is a vertical screw mixer which can be used in a continuous flow process.

According to the present invention there is provided a vertical screw mixer which is comprised of an elongate container having a bottom, a first end, a second end, and containing walls which extend between the first end and the second end. At least one opening is provided in the container whereby raw material to be processed enters the container. A plurality of generally conical processing screws are positioned at spaced intervals between the first end and the second end. Each of the processing screws has an axis of rotation which is angularly offset from vertical by inclining the axis of rotation toward the second end of the container, such that a flow of material is promoted from the first end toward the second end. An outlet is positioned adjacent the second end whereby processed material exits the container.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
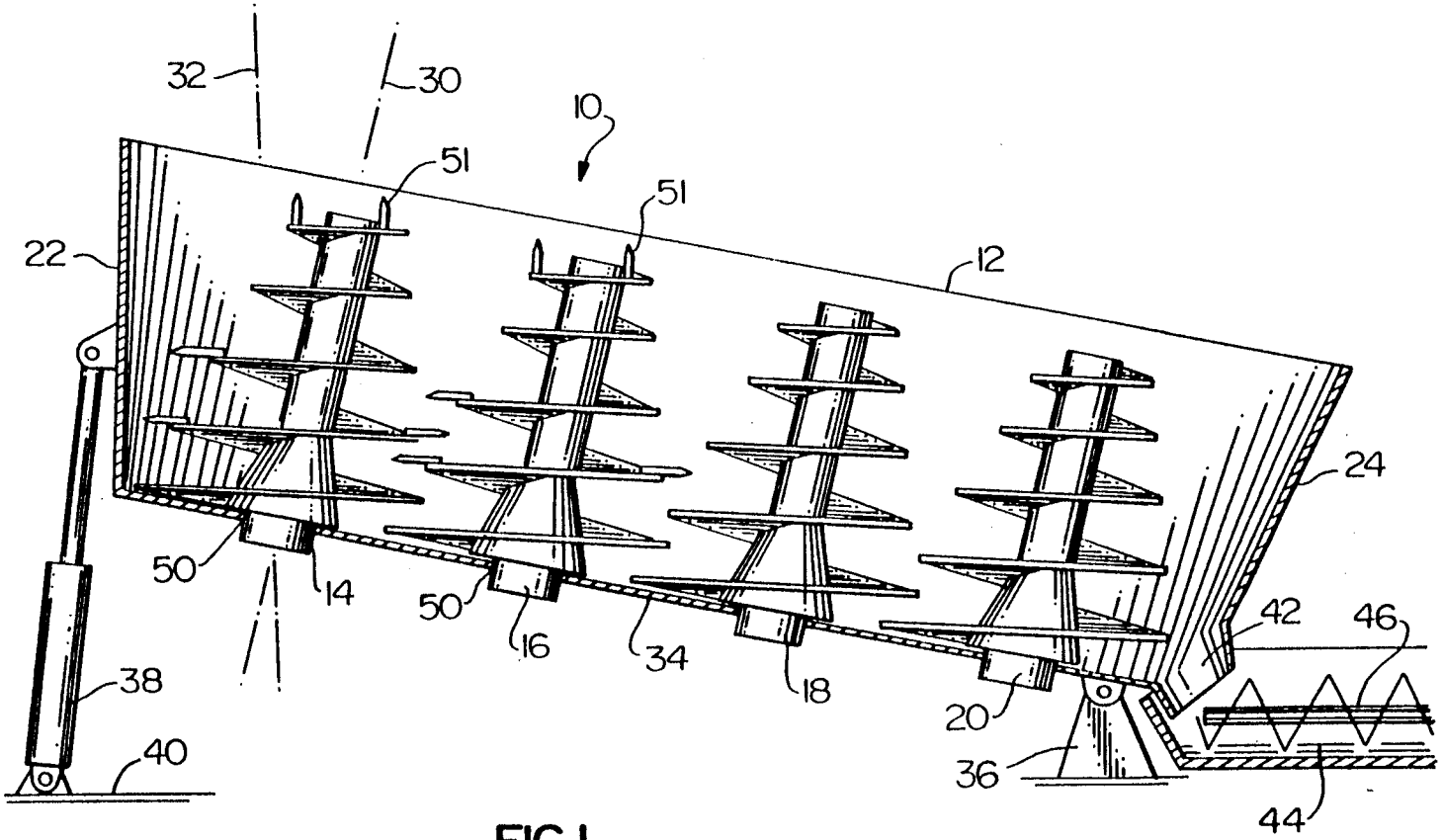
FIG. 1 is a longitudinal section view of a mixer constructed in accordance with the teachings of the present invention.

The preferred embodiment, a vertical screw mixer generally identified by reference numeral 10, will now be described with reference to FIGS. 1 and 2.

Figure 2:
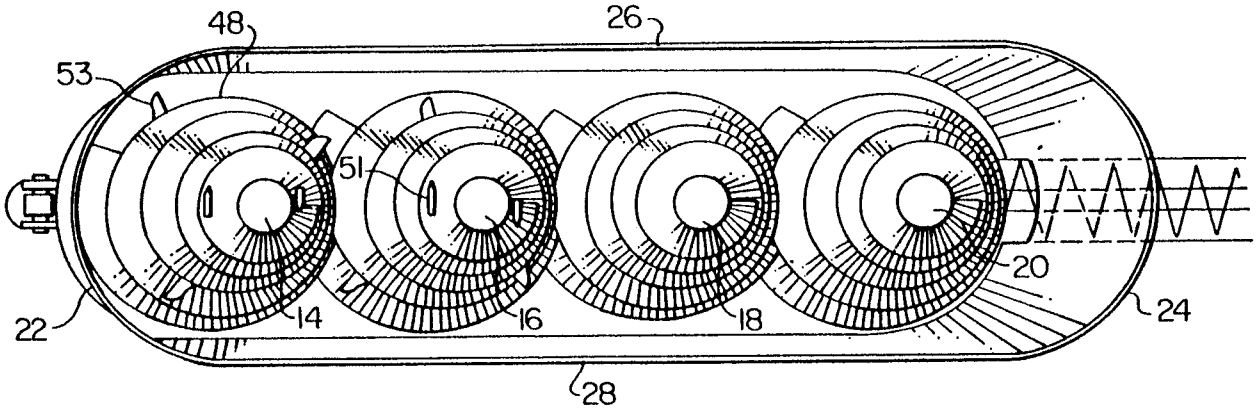
FIG. 2 is a top plan view of the mixer illustrated in FIG. 1.

Referring to FIG. 1, the primary components of Mixer 10 are an elongate container 12 and a plurality of conical processing screws 14, 16, 18, 20. Elongate container 12 has an arcuate first end wall 22, an arcuate second end wall 24, and containing walls 26 and 28, respectively, which extend between first end wall 22 and second end wall 24. Conical processing screws 14, 16, 18, and 20 are spaced intervals between first end wall 22 and second end wall 24 forming a single row. To increase the capacity of mixer 10, the row can be lengthened, staggered, or additional rows added. Each of processing screws 14, 16, 18, and 20 have an axis of rotation 30 which is angularly offset from vertical, represented by the broken line identified by reference numeral 32. Axis of rotation 30 of each of processing screws 14, 16, 18, and 20 is inclined toward second end wall 24 of container 12. In the preferred embodiment axis of rotation 30 of processing screws 14, 16, 18, and 20 is angularly offset from vertical 32 by having processing screws 14, 16, 18, and 20 mounted substantially perpendicular to a bottom 34 in container 12 and positioning container 12 such that bottom 34 is downwardly sloping from first end wall 22 toward second end wall 24. Container 12 is mounted on a pivotal support 36 positioned adjacent second end wall 24. An hydraulic actuator 38 is positioned under first end wall 22, first end wall 22 of container 12 may be raised or lowered by means of hydraulic actuator 38, to alter the angle of incline of bottom 34 in relation to a horizontal plane as identified by reference numeral 40. Upon the angle of bottom 34 being altered the angular offset of axis of rotation 30 of processing screws 14, 16, 18, and 20 is similarly altered. A processed material outlet 42 is positioned adjacent second end wall 24. This processed material outlet can be gravity fed, however, it is preferred that an outlet channel 44 be provided with an insitu auger 46. Referring to FIG. 2, in order to achieve a more aggressive mixing action each of processing screws 14, 16, 18, and 20 have flights 48 which are overlapping. In the illustrated embodiment container 12 is open to facilitate receiving raw material. This enables differing streams of raw material to enter container 12 to be mixed. The amount of mixing required will depend upon the nature of the raw material. Some raw material will be in large bales, whereas other material will be in a liquid state. Liquid materials can be placed into container 12 at processing screw 20, whereas bales of material must be placed into container 12 adjacent screw 14. It is to be noted in FIG. 1, that processing screws 14 and 16 are supported solely at base 50 in order that material can enter from above without obstruction. Processing screws 14 and 16 having upwardly extending cutting blades 51 and flights 48 with outwardly protruding cutting blades 53. Raw material in bales enters container 12 directly onto processing screws 14 and 16. Screws 14 and 16 move the material upward, causing the bales of material to "bounce" upon screws 14 and 16. It is preferred that bales of material be held in position by impaling fingers (not shown) which impede the rotation and upward movement of the bale of material in order to make upwardly extending cutting blades 51 more effective. Cutting blades 51 and 53 cut the bales into chunks which are then further mixed by processing screws 18 and 20. Drive means (not shown) must be provided to supply a rotational force to processing screws 14, 16, 18, and 20. The type of drive means required is known in the art and will therefore not be further described.

The use and operation of Mixer 10 will now be described with reference to FIGS. I and 2. Mixer 10 is intended for installation in an application where a continuous flow of material is desired. A typical configuration would consist of several hoppers (not shown) of raw material fed by feed augers or conveyers (not shown) directly into the open top of container 12. Raw material requiring cutting as well as mixing is placed directly onto processing screw 14 where it is cut into chunks by cutting blades 51 and 53. Other raw material can be added later in the process depending upon the amount of mixing required. The angle of incline of bottom 34 creates a tendency for the material to move from first end wall 22 toward second end wall 24 by force of gravity. Force of gravity alone, however, may not be sufficient to promote movement, depending upon the viscosity of the raw material. The inclined axis of rotation 30 of processing screws 14, 16, 18, 20 results in the raw material being "passed" from processing screw to processing screw. The mixing action and the movement of material from first end wall 22 to second end wall 24 is enhanced by the overlapping of flights 48 on processing screws 14, 16, 18, and 20. By the time the material reaches second end wall 24 the mixing process is complete and the material is ready for removal through processed material outlet 42. The processed material passes through processed material outlet 42, enters outlet channel 44 and is rapidly moved to the next station for loading or further processing by insitu auger 46. If the material reaching processed material outlet 42 is not mixed sufficiently, the speed of rotation of processing screws 14, 16, 18, and 20 should be increased, the angle of bottom 34, or both. The angle of bottom 34 is adjusted by raising or lowering first end wall 22 of container 12 by means of hydraulic actuator 38. Upon activation of hydraulic actuator 38, container 12 pivots around pivotal support 36 positioned adjacent second end wall 24 to alter the angle of bottom 34.

Figure 3:
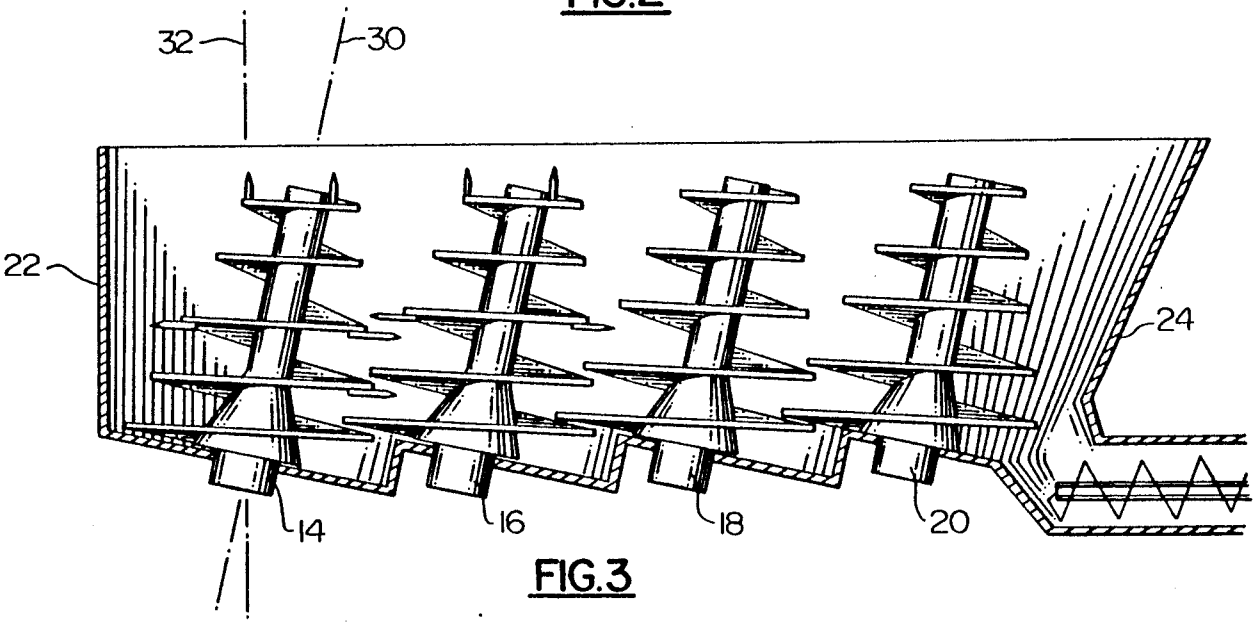
FIG. 3 is a longitudinal section view of an alternate embodiment of a mixer constructed in accordance with the teachings of the present invention.

FIG. 3 illustrates an alternative way to put the invention into effect. In particular, axis of rotation 30 of each of processing screws 14, 16, 18, and 20 is shown to be inclined toward second end wall 24 of container 12, without means being provided to raise or lower bottom 34. It must be emphasized that the movement of material between first end wall 22 and second end wall 24 can be accomplished solely through the inclining of axis of rotation 30 of the screws without the sloping of bottom 34.

It will be apparent to one skilled in the art that with the present invention a continuous flow of material is promoted from first end wall 22 toward processed material outlet 42 adjacent second end wall 24 of container 12.

It will be apparent to one skilled in the art that the illustrated Mixer may be modified for use as a Cutter/-mixer by the addition of blades to the screw, and other related ancillary modifications.

A vertical screw mixer as described has application in many industries. It is particularly suited to the processing of garbage. The reason for this is that the processing screws have a tendency to lift up the material, which reduces the potential for foreign material jamming the equipment.

It will also be apparent to one skilled in the art that modifications may be made to the illustrated embodiment without departing from the spirit and scope of the invention as defined in the claims.

The embodiment of the invention in which an exclusive property or privilege is claimed and defined as follows:

1. A mixer, comprising:

a. an elongate container having a bottom, a first end, a second end, and containing walls which extend between the first end and the second end;

b. at least one opening in the container whereby raw material to be processed is directed into the container;

c. a plurality of generally vertical conical processing screws positioned at spaced intervals between the first end and the second end, each of the processing screws having an axis of rotation which is angularly offset from vertical by inclining the axis of rotation toward the second end of the container, such that a flow of the raw material is promoted from the first end wall toward the second end wall;

d. a processed material outlet positioned adjacent the second end, whereby processed material exits the container; and e. means being provided to adjust the angular offset of the axis of rotation of the processing screws thereby accommodating the viscosity of the raw material being mixed in a continuous flow process with the raw material continuously being fed into the at least one opening and continuously exiting the processed material outlet.

2. The mixer as defined in claim 1, the axis of rotation of the processing screws being angularly offset from vertical by having the processing screws mounted substantially perpendicular to the bottom of the container and having the bottom downwardly sloping from the first end toward the second end.

3. The mixer as defined in claim 2, means being provided to alter the angle of the slope of the bottom in relation to a horizontal plane thereby altering the angular offset of the axis of rotation of the processing screws.

4. The mixer as defined in claim 1, the processing screws having overlapping flights.

5. The mixer as defined in claim 1, at least one of the processing screws adjacent the first end of the container having flights with outwardly protruding cutting blades.

6. The mixer as defined in claim 1, having a first processing screw positioned immediately adjacent the first end which is supported solely at its base, the at least one raw material inlet opening being positioned above the first processing screw.

7. The mixer as defined in claim 6, the first processing screw having upwardly extending cutting blades.

8. A mixer, comprising:

a. a support;

b. an elongate container having a bottom, a first end, a second end, and containing walls which extend between the first end and the second end, the second end of the container being pivotally mounted to the support for movement about a substantially horizontal axis;

c. at least one opening in the container whereby raw material to be processed is directed into the container;

d. a plurality of generally vertical conical processing screws positioned at spaced intervals between the first end and the second end, each of the processing screws having an axis of rotation which is angularly offset from vertical by inclining the axis of rotation toward the second end of the container, such that a flow of the raw material is promoted from the first end wall toward the second end wall, the axis of rotation of the processing screws being angularly offset from vertical by having the processing screws mounted substantially perpendicular to the bottom of the container and having the bottom downwardly sloping from the first end toward the second end; and e. a processed material outlet positioned adjacent the second end, whereby processed material exits the container;

f. means being provided to alter the elevation of the first end of the container thereby altering the angle of the slope of the bottom in relation to a horizontal plane and the angular offset of the axis of rotation of the processing screws to accommodate the viscosity of the raw material being mixed in a continuous flow process with the raw material continuously being fed into the at least one opening and continuously exiting the processed material outlet.

* * * * *